US006638013B2

(12) United States Patent
Nguyen et al.

(10) Patent No.: US 6,638,013 B2
(45) Date of Patent: Oct. 28, 2003

(54) THERMALLY ISOLATED HOUSING IN GAS TURBINE ENGINE

(75) Inventors: Ly D. Nguyen, Phoenix, AZ (US); Louis Cruse, Scottsdale, AZ (US); Ivar Gene Fowkes, Tempe, AZ (US); Silvestre Salas, Chandler, AZ (US); William North, Tempe, AZ (US); Vadanth Kadambi, Scottsdale, AZ (US)

(73) Assignee: Honeywell International Inc., Morristown, NJ (US)

( * ) Notice: Subject to any disclaimer, the term of this patent is extended or adjusted under 35 U.S.C. 154(b) by 67 days.

(21) Appl. No.: 10/084,209

(22) Filed: Feb. 25, 2002

(65) Prior Publication Data

US 2003/0161718 A1 Aug. 28, 2003

(51) Int. Cl.[7] ..... F01D 25/12
(52) U.S. Cl. ..... 415/115; 415/176; 415/178
(58) Field of Search ..... 415/115, 116, 415/134, 138, 137, 139, 176, 178, 180

(56) References Cited

U.S. PATENT DOCUMENTS

| | | | |
|---|---|---|---|
| 3,826,084 | A | 7/1974 | Branstrom et al. |
| 4,079,587 | A | 3/1978 | Nordström et al. |
| 4,466,239 | A | 8/1984 | Napoli et al. |
| 4,487,016 | A | 12/1984 | Schwarz et al. |
| 4,541,775 | A | 9/1985 | Hovan |
| 4,645,415 | A | 2/1987 | Hovan et al. |
| 4,920,742 | A | 5/1990 | Nash et al. |
| 5,142,859 | A | 9/1992 | Glezer et al. |
| 5,169,287 | A | 12/1992 | Proctor et al. |
| 5,212,940 | A | 5/1993 | Glover |
| 5,273,397 | A | 12/1993 | Czachor et al. |
| 5,291,733 | A | 3/1994 | Halila |
| 5,461,866 | A | 10/1995 | Sullivan et al. |
| 5,597,286 | A | 1/1997 | Dawson et al. |
| 5,634,767 | A | 6/1997 | Dawson |
| 6,050,079 | A | 4/2000 | Durgin et al. |
| 6,227,800 | B1 | 5/2001 | Spring et al. |

*Primary Examiner*—Edward K. Look
*Assistant Examiner*—Dwayne J. White
(74) *Attorney, Agent, or Firm*—Robert Desmond, Esq.

(57) ABSTRACT

An apparatus and system for thermally isolating a gas turbine housing from the significantly high temperatures associated with the combustion gases flowing through the housing. A floating liner is assembled within the housing with an outer baffle surrounding the floating liner and an inner baffle disposed within the floating liner. The floating liner creates a thermally isolated device to cover and protect the housing from high temperature. Openings formed in the outer baffle, floating liner and inner baffle create a single, continuous cooling passageway within the housing for collecting heat from adjacent the surfaces of the floating liner and expelling the heat into the combustion exhaust stream.

20 Claims, 8 Drawing Sheets

THERMALLY ISOLATED HOUSING IN GAS TURBINE ENGINE

This invention was made with government support under contract no. DAAJ02-94-C-0030 with the U.S. Army. The government has certain rights in the invention.

BACKGROUND OF THE INVENTION

The present invention is directed to a gas turbine engine assembly of a type capable of operating at elevated temperatures. In particular, the present invention is directed to an assembly creating a single cooling circuit for thermally isolating the turbine housing from high temperatures that would otherwise adversely impact the delivery of cooling air/oil through the high temperature gas path to cool bearings, seals, nozzles and other engine components as well as maintaining the housing structural integrity.

Recent advances in turbine engine technology utilize ceramic combustor technology which can operate at temperatures exceeding even 2500 ° F. It is essential that some housings must be cooled effectively and efficiently. Cooling the engine components while maintaining and even increasing engine efficiency and power are possible by operating at such higher temperatures without compromising the system.

Typically, such high temperature gas turbine engines require many complex cooling circuits to isolate the housing from high temperature gases. Separate cooling circuits are often utilized to cool the gas path liner and air/oil passages extending through the struts as required for lubrication of bearings, seals, turbine blades and associated engine components.

To insure adequate cooling, engine assemblies currently may utilize a circular inner hub and outer housing or shroud joined by a number of radially-extending support struts passing through the hot gas flow path. The struts may have hollow core areas extending lengthwise through the core for delivering air/oil to cool the bearings, nozzles and other components. The design of such inner hubs may accommodate bearings and various seal arrangements, while the outer shroud supports other ancillaries. The separate cooling circuits required for such shroud and hub assemblies are complex and expensive to fabricate and maintain.

There clearly is a need for an apparatus capable of creating a single cooling circuit which is simply supported within the engine compartment and capable of successfully isolating the entire engine housing from the high temperatures created by the gas combustion process, thereby enabling the housing to deliver cooling air to the bearings, seals, nozzles and other engine components.

SUMMARY OF THE INVENTION

In one aspect of the present invention, an apparatus is disclosed for thermally isolating a turbine engine housing from high temperatures created by combustion gases flowing through the engine. The apparatus includes a floating liner assembly that may be positioned within the engine housing, with a plurality of openings extending through the baffles. An outer baffle assembly may surround the floating liner assembly, with a plurality of openings extending through the outer baffle assembly. An inner baffle assembly may be arranged within the floating liner assembly, with a plurality of openings extending through the inner baffle. The floating liner assembly, the outer baffle assembly and the inner baffle assembly may be arranged to form a single passageway for conveying a stream of compressed, cooling air against said floating liner to extract heat from said floating liner by both conduction and convection. The cooling air after extracting heat is then expelled into a stream of combustion gases flowing through turbine engine.

In another aspect of the invention, a system is disclosed for thermally isolating a gas turbine engine housing having an outer ring-shaped housing member and an inner hub attached by housing struts from high temperatures created by combustion gases flowing through the turbine engine. The system includes a floating liner assembly that may be disposed between the inner hub and the outer ring-shaped housing member and may further include a plurality of liner struts enclosing the housing struts, with a plurality of openings extending through the floating liner. An outer baffle assembly may surround the floating liner assembly, with a plurality of openings extending through portions of the outer baffle assembly. An inner baffle assembly may be disposed within the floating liner assembly, with a plurality of openings extending through portions the inner baffle. A continuous stream of pressurized air may enter the outer ring-shaped housing member and may flow through the openings in the outer baffle assembly. The air stream may be directed against the floating liner to collect heat from the floating liner and expel the heat to a stream of combustion gases flowing through the gas turbine engine.

In a yet further aspect of the present invention, an apparatus and system are disclosed for thermally isolating an outer ring-shaped housing member of gas turbine engine having a number of inlets and an inner hub attached the outer ring-shaped housing member by a plurality of separate housing struts, from high temperatures created by combustion gases flowing through the turbine engine. The apparatus and system may include a floating liner assembly disposed between the inner hub and the outer ring-shaped housing member. The floating ring may include separate, radially-disposed inner and outer ring-shaped members, with each ring-shaped member having a number of openings. This may form a cooling air passageway adjacent each of the floating liner ring-shaped inner and outer members. An outer baffle assembly may be formed of two similar, generally cylindrically-shaped members attached to one another and surrounding the floating liner outer ringshaped member, with a plurality of openings extending through each outer baffle member. An inner baffle assembly may be formed of two similar, generally cylindrically-shaped members arranged within the floating liner inner ring-shaped member, with a plurality of openings extending through each inner baffle member. A single, continuous air cooling circuit may extend through the outer ring-shaped housing member and may flow through the openings in the outer and inner baffle assemblies, impacting on each of the floating liner inner and outer ring-shaped members. The stream may collect heat from each of the floating liner inner and outer ring-shaped members and expel the heat to a stream of combustion gases flowing through the gas turbine engine These and other features, aspects and advantages of the present invention will become better understood with reference to the following drawings, description and claims.

DETAILED DESCRIPTION OF THE INVENTION

The following detailed description is of the best currently contemplated modes of carrying out the present invention. The description is not to be taken in a limiting sense, but is made merely for the purpose of illustrating the general principles of the invention, since the scope of the invention is best defined by the appended claims.

Figure 1:
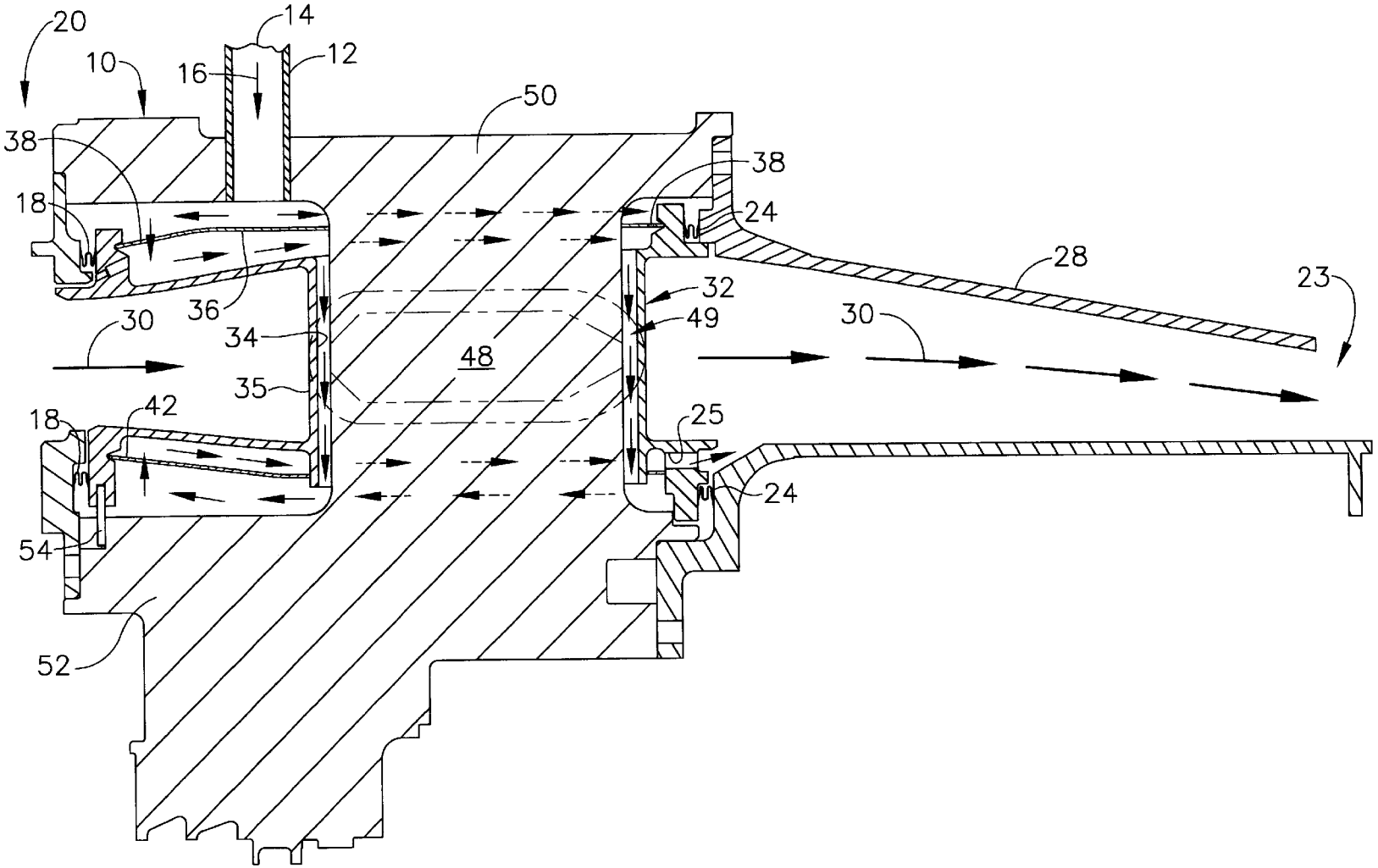
FIG. 1 is a schematic view of a gas turbine engine having a thermally cooled housing assembly formed in accordance with the present invention.

The gas turbine engine formed in accordance with the present invention includes an assembly and system for thermally isolating housing from high temperatures in the gas path that otherwise adversely affect the housing and its cooling passages. The apparatus allows the turbine engine to function without thermal interference of the type caused by transient conditions existing during system startup and shutdown. Referring now to FIG. 1, a thermally isolated housing assembly is shown at 10. An inlet pipe 12 can be attached to housing 10 and may deliver a quantity of relatively cool, compressed air through a number of inlets 14 extending through housing 10. As shown by the arrows 16, a portion of the compressed cooling air may circulate in a forward direction through the housing until reaching typical metal seals 18 located at the forward end 20 of the turbine engine. The cool air 16 continues to flow through a cavity created between the liner 35 and strut 48 to the hub of the housing 10. A further portion of the cooling air 16 also flow towards forward end 20 of the turbine engine to cool the hub of the housing 10 prior to flow toward the rear end of the engine housing. The cooling air 16 may pass adjacent the rear metal air seals 24 before being expelled from the air circuit through one or more outlets 25. The expelled cooling air can mix with the turbine gas 30 flowing through the exhaust nozzle 28.

Figure 2:
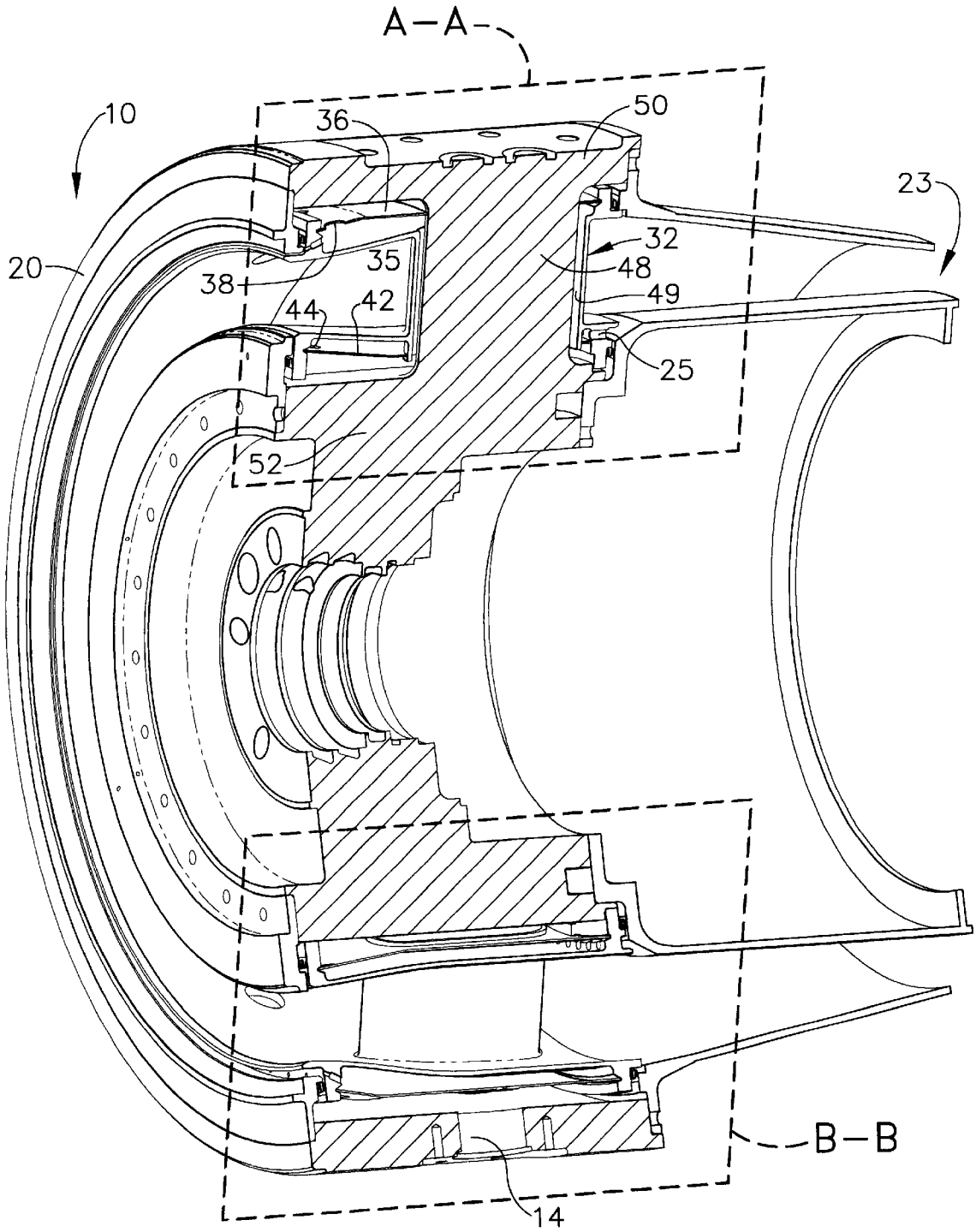
FIG. 2 is a perspective view of one-half the thermally cooled housing assembly formed in accordance with the present invention.
Figure 5:
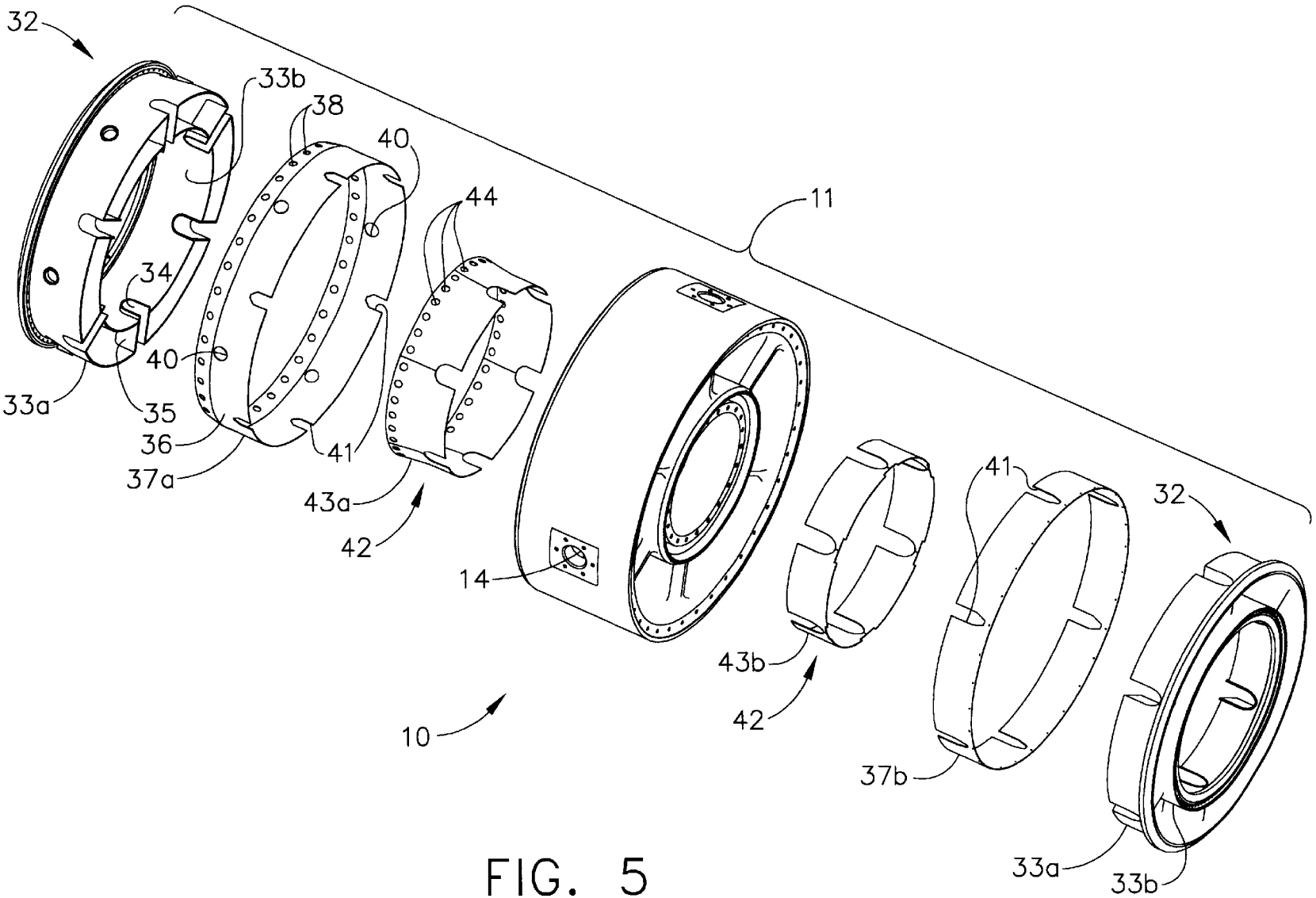
FIG. 5 is a perspective view of the thermally cooled housing assembly formed in accordance with the present invention.
Figure 6:
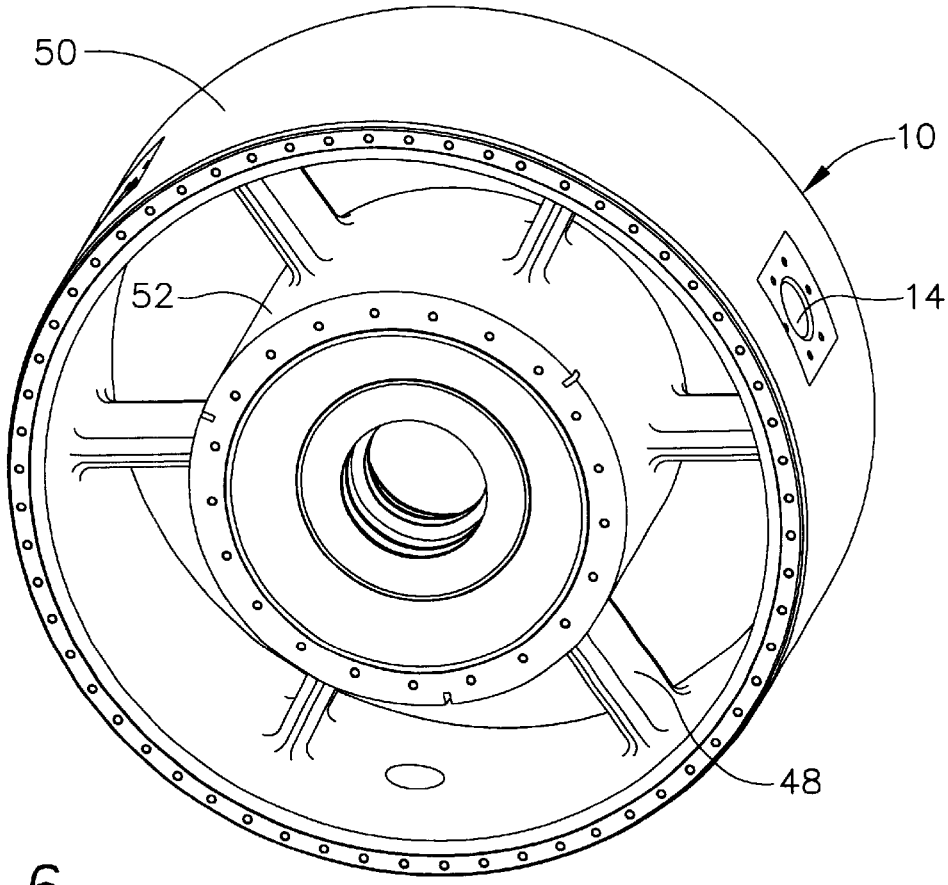
FIG. 6 is a perspective view of the thermally isolated housing without the liner assembly formed in accordance with the present invention.
Figure 7:
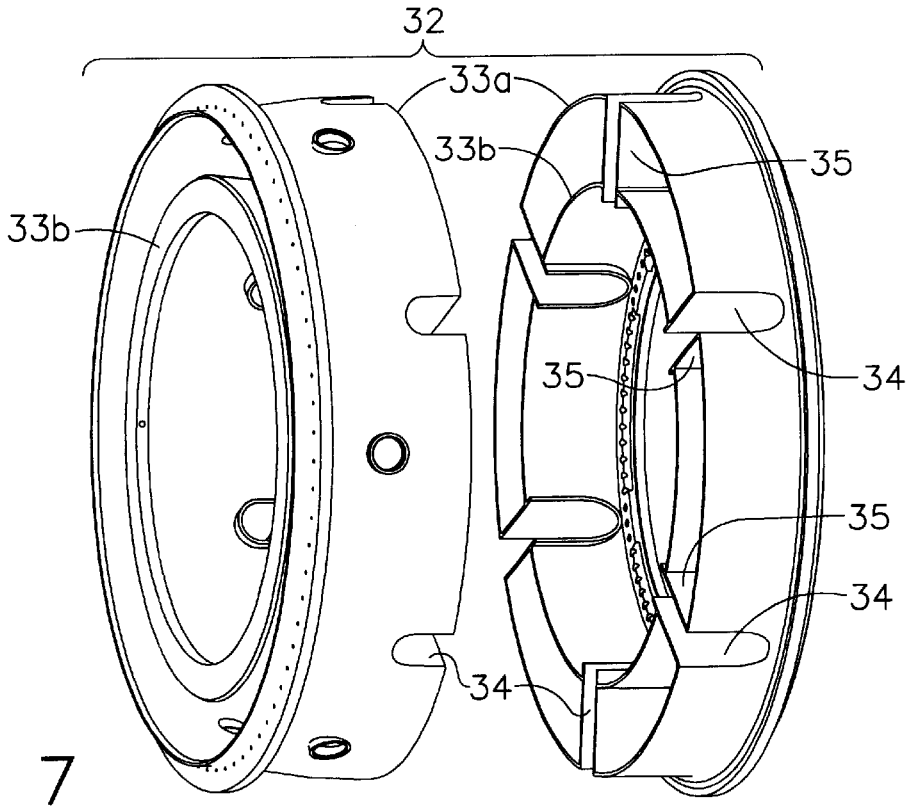
FIG. 7 shows an isometric view of the floating liner assembly formed in accordance with the present invention.
Figure 8A:
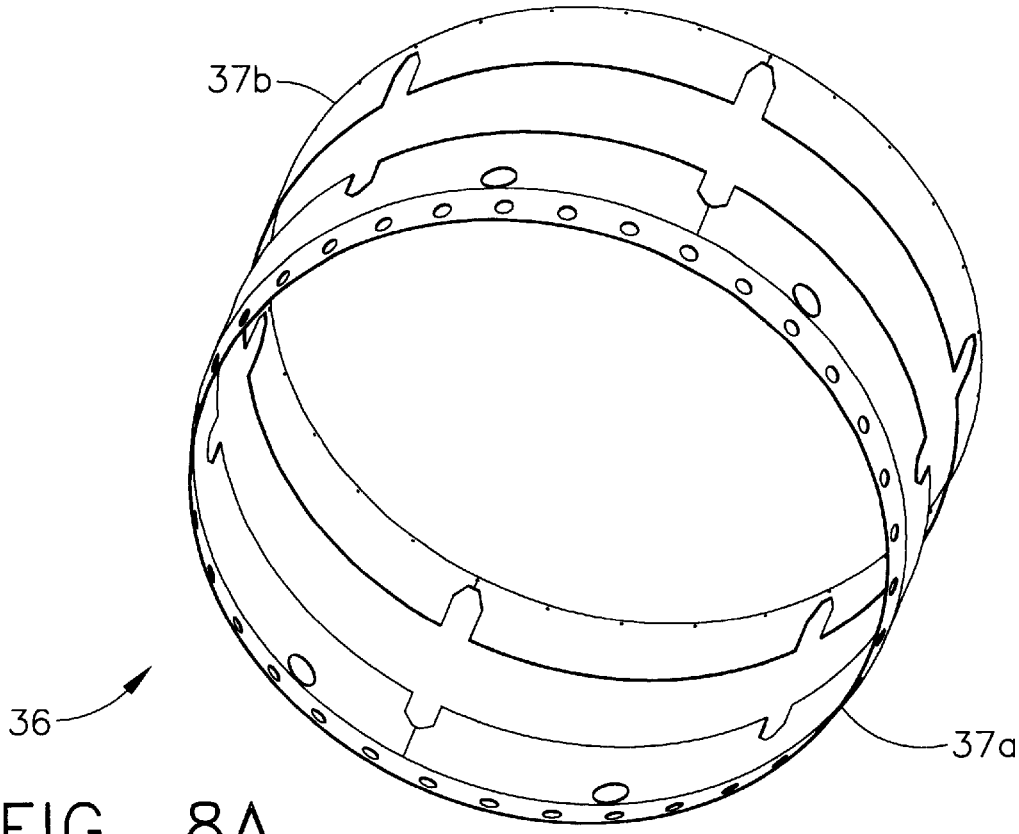
FIGS. 8*a* and 8*b* show perspective views of portions of the inner and outer baffle members.
Figure 8B:
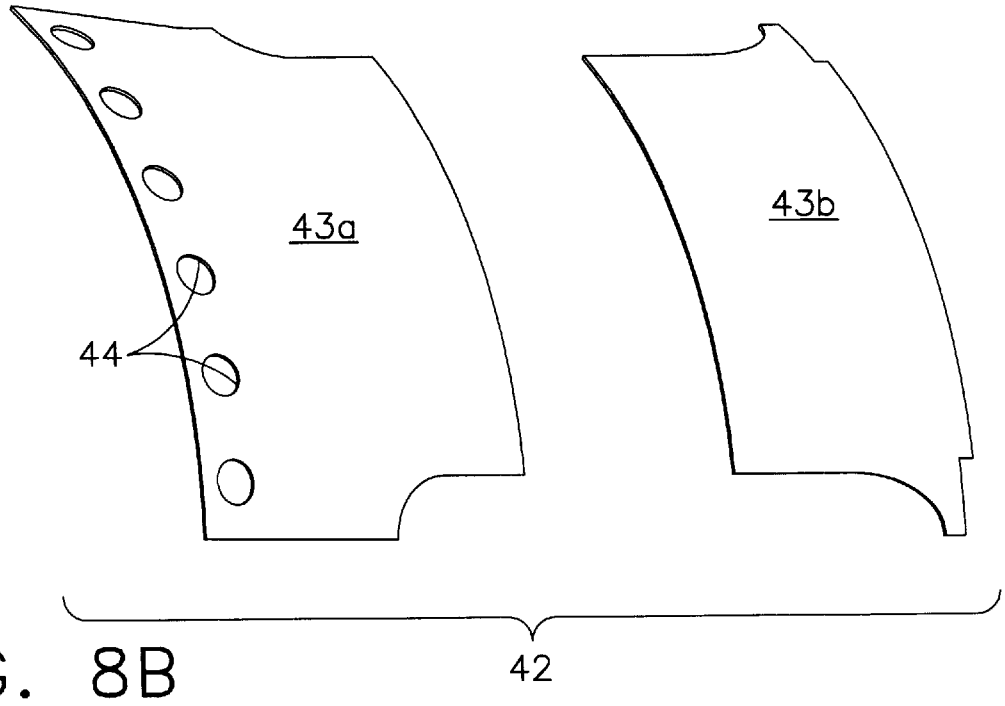
Figure 9A:
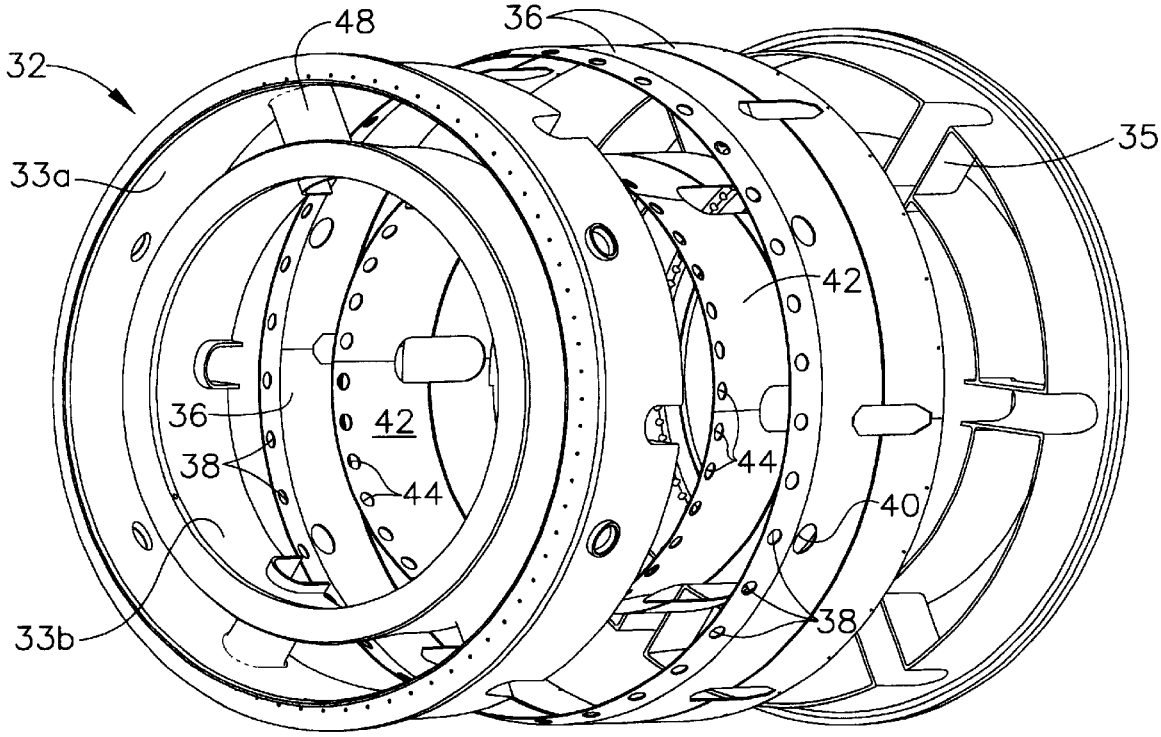
FIG. 9*a* shows an exploded perspective view of the thermally isolated housing, baffles and floating liner assembly formed in accordance with the present invention.
Figure 9B:
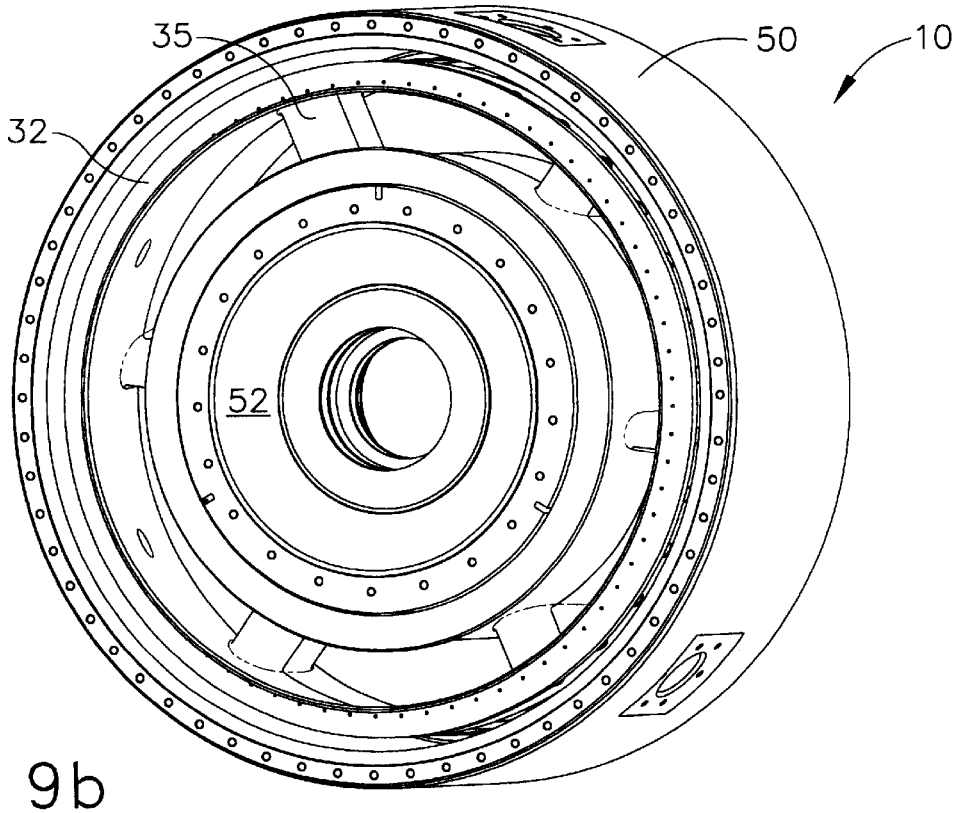
FIG. 9*b* shows a view of the floating liner and baffle assembled into the thermally isolated housing as formed in accordance with the present invention.

As shown in FIGS. 2 and 5 and 6, thermally isolated housing 10 encloses a cooling apparatus 11 that can include a number of radially-aligned components. Among the components can be a floating liner 32 that may be formed as a single assembly or, preferably, constructed from outer and inner ring members 33*a* and 33*b*, respectively. When assembled, the outer ring member 33*a* may surround and can be radially-spaced from the inner ring member 33*b*. A number of hollow liner struts 35 may extend between the ring members. A number of openings 34 may extend through each of the outer and inner ring-shaped members 33*a* and 33*b* to form an air flow passageway through outer ring member 33*a*, strut 35 and inner ring member 33*b*, allowing a single stream of cooling air to circulate adjacent each floating liner ring member as will become clear.

Cooling apparatus 11 can also include an outer baffle assembly 36 that may be formed as a single, cylindrically-shaped member or, preferably, may be formed from two separate, cylindrically-shaped portions 37*a* and 37*b*, respectively. Portions 37*a* and 37*b* may be welded together to form a closed cylinder during assembly. When assembled, outer baffle assembly 36 can enclose floating liner outer ring member 33*a* and 33*b*. A plurality of circumferentially-spaced openings 38 and 40 extend through outer baffle portion 37*a*, allowing cooling air to pass through baffle portion 37*a* and flow adjacent to floating liner 32. Each of the portions 37*a* and 37*b* further includes aligned slot portions 41 that engage one another to form enlarged openings as baffle portions 37*a* and 37*b* are assembled. As will be explained, the enlarged openings formed by slots 41 enclose strut-shaped connecting members forming additional air passageways through the baffle assembly 36.

further part of cooling apparatus 11, inner baffle assembly 42, may be arranged within floating liner inner ring member 33*b*. Inner baffle assembly 42 may be formed as a single, cylindrically-shaped member or, preferably, may be formed from separate, cylindrically-shaped members 43*a* and 43*b*, respectively. Further, each of the cylindrical members 43*a* and 43*b* may, itself, be formed by a number of arc-shaped segments welded to form the continuous cylinder. The number of segments can depend on the number of struts and contour shape. By forming the inner baffle cylindrical portions from a number of arc-shaped segments, ease of assembly is assured. A number of openings 44 extend through inner baffle assembly 42, allowing cooling air to circulate through the inner baffles 42 and adjacent floating liner inner ring member 33*b*.

Figure 3:
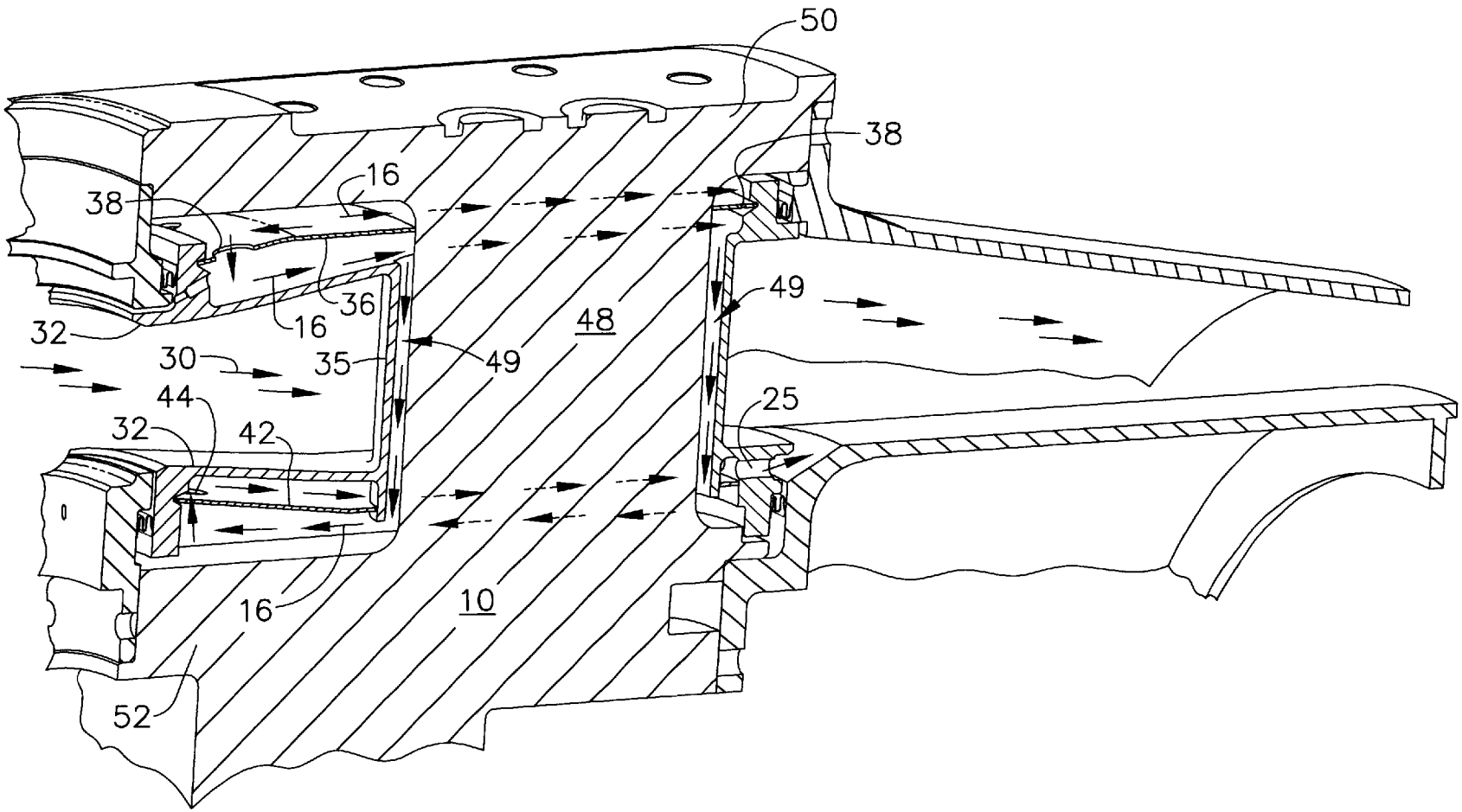
FIG. 3 is an exploded view taken along the lines A—A in FIG. 2.

Referring now to FIGS. 3 and 6, thermally isolated housing assembly 10 can further include a number of radially-disposed hollow housing struts 48 extending between and joining an outer shroud ring-shaped housing member 50 and a cylindrically-shaped inner hub member 52. This assembly allows cooling air/oil to be circulated between outer housing member 50 and inner hub 52, for cooling the bearings and seal assemblies contained within hub 52. When assembled, cooling apparatus 11 having floating liner assembly 32 and associated outer baffle assembly 36 and inner baffle assembly 42, is positioned between outer, housing member 50 and inner hub 52, with floating liner struts 35 encasing the housing struts 48 and creating an air flow passageway 49 there between.

Referring again to FIG. 1, a number of circumferentially-spaced clocking or dowel pins 54 may extend between housing 10 and a forward portion of floating liner 32 for properly orienting floating liner 32 within housing 10. Controlling circumferential expansion and orientation are particularly important during the engine operating thermal cycle.

Figure 4:
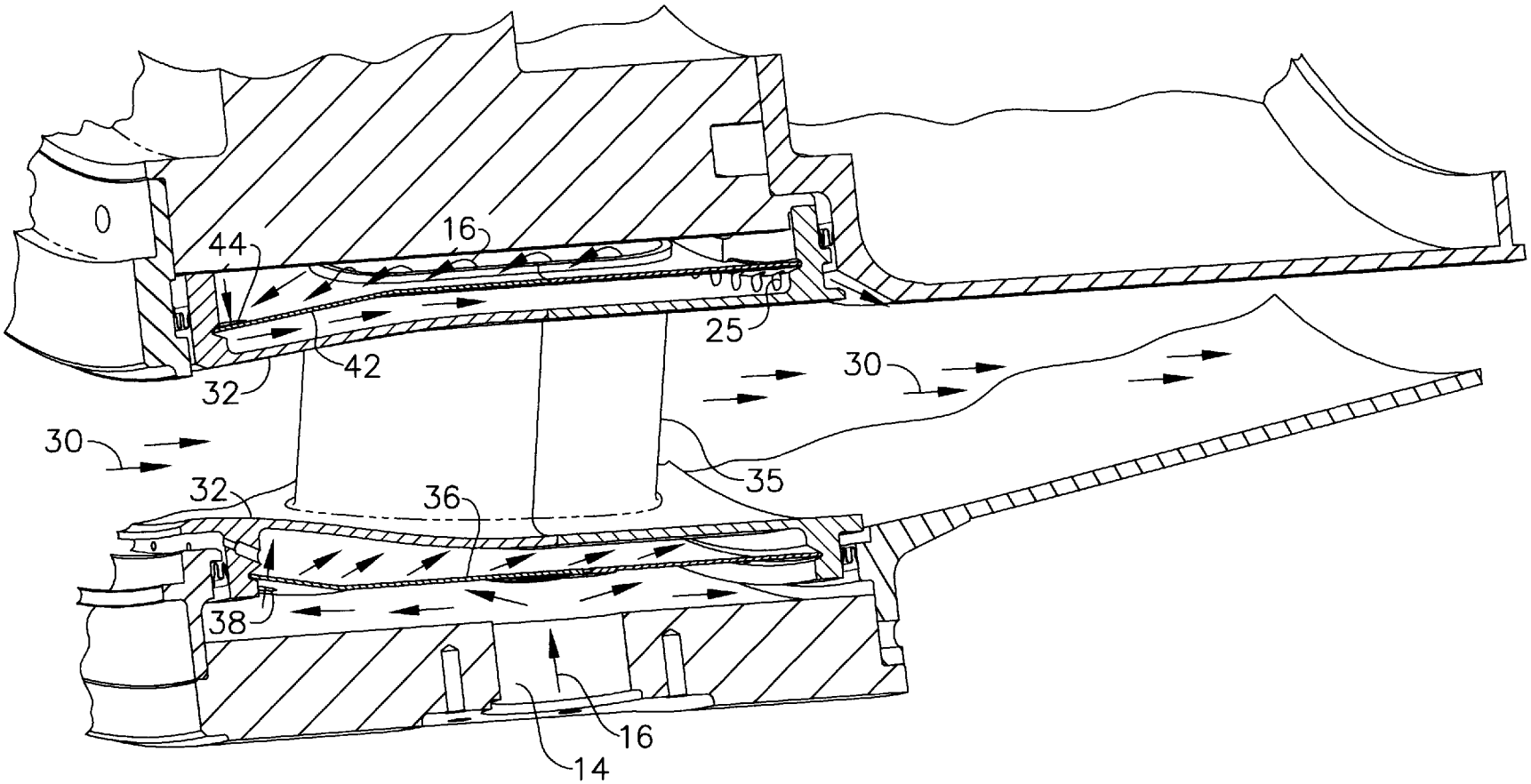
FIG. 4 is an exploded view taken along the lines B—B in FIG. 2.

The present invention may provide a single air circuit capable of circulating compressed air within the engine housing compartment adjacent floating liner outer and inner rings 33*a* and 33*b*, respectively. As shown in FIGS. 2–4, a stream of compressed cooling air 16 enters housing 10 via a number of the inlet openings 14. As the compressed air impinges on the outer baffle assembly 36, it diffuses, with most of the cooling air 16 moving toward the forward end 20 of housing 10, while the remaining cooling air 16 moves toward the aft end 23 of housing 10. The cooling air stream 16 may move through the openings 38 and 40 in outer baffle 36 and flow adjacent to the surface of floating liner outer ring 33*a* in both axial and circumferential directions. This extracts heat from all outer surfaces of floating liner outer ring 33*a* forming a boundary with the hot flow gases 30. A further portion of cooling air 16 may flow inwardly through the openings in floating liner outer ring 33*a* and into the through passageway 49 defined by housing strut 48 and floating liner strut 35. The cooling air exits via additional openings 34 in the floating liner inner ring member 33*b* and is directed between inner baffle 42 and floating liner inner ring 33*b*. The cooling stream of air can collect heat from the floating liner inner ring 33*b* and expel it through outlets 25 into the stream of combustion gases 30 flowing through exhaust 28.

Cooling apparatus 11 including floating liner 32, outer baffle assembly 36 and inner baffle assembly 42 is specifically designed to isolate the thermal interference which may arise in housing 10 and otherwise prevent delivery of cooling air to the engine components that must be cooled, i.e., seals, bearings, turbine blades during thermal transient cycles. The forward and aft portions of the floating liner 32 and baffles 36 and 42 are protected against axial thermal expansion by the seal assemblies 22 and 24 which may take the form of typical metal seals such as W, C configuration or piston seals. Because floating liner 32 can be circumferentially clocked at the forward end by the three dowel pins 54 radially piloted within the aft end of housing 10, it can remain in its pre-determined location in the flow path 30 of the hot engine gases. Floating liner 32 along with its single cooling circuit extending between liner 32 and both baffles 36 and 42 serves to extract and expel heat from liner 32 which would otherwise damage the housing shroud 50 and its ability to deliver cooling air/oil to hub 52 to cool bearings, nozzles and other components.

It should be understood, of course, that the foregoing relates to preferred embodiments of the invention and that modifications may be made without departing from the spirit and scope of the invention. For example, the floating liner 32, outer baffle 36 and inner baffle 42 may each be formed from a single member rather than from a number of separate members. The location of the openings extending through floating liner 32 and the baffles 36 and 42 may be altered to adjust the flow path for the compressed cooling air 16 and thereby maximize its cooling affect. These any other modifications should in no way limit the scope of the invention, which should only be determined based on the following claims.

We claim:

1. An apparatus for thermally isolating a turbine engine housing from high temperatures created by combustion gases flowing through the engine, comprising:

a floating liner assembly disposed within the engine housing, with a plurality of openings extending through the floating liner;

an outer baffle assembly surrounding the floating liner assembly, with a plurality of openings extending through the outer baffle assembly;

an inner baffle assembly disposed within the floating liner assembly, with a plurality of openings extending through the inner baffle; and said floating liner assembly, said outer baffle assembly and said inner baffle assembly arranged forming a single passageway for conveying a stream of compressed, cooling air against said floating liner to collect heat from said floating liner and expel the heat into a stream of combustion gases flowing through said turbine engine.

2. The thermally isolating apparatus according to claim 1, wherein the outer baffle assembly comprises two separate baffle members attached to one another, with each baffle member having a generally cylindrically-shaped configuration and a number of through openings forming cooling air passageways adjacent and through the outer baffle assembly.

3. The thermally isolating apparatus according to claim 1, wherein the outer baffle assembly is formed of a single, generally cylindrically-shaped member having a plurality of through openings forming cooling air passageways extending adjacent and through the outer baffle assembly.

4. The thermally isolating apparatus according to claim 1, wherein the housing has an outer ring-shaped housing member and an inner hub connected by a number of hollow housing struts having lengthwise passages for delivering air/oil from the outer ring-shaped housing member to the inner hub.

5. The thermally isolating apparatus according to claim 4, wherein the floating liner assembly comprises a single member having a generally cylindrically-shaped configuration including outer and inner ring portions separated by a plurality of hollow liner struts, with the floating liner disposed between the outer ring-shaped housing and the inner hub and the floating liner struts encasing the housing struts.

6. The thermally isolating apparatus according to claim 4, wherein the floating liner assembly comprises separate radially-disposed inner and outer ring-shaped members, with each ring-shaped member having a having a number of openings, and the floating liner assembly further comprises a plurality of hollow struts extending between the ring-shaped inner and outer members, forming an cooling air passageway adjacent each of the floating liner ring-shaped inner and outer members.

7. The thermally isolating apparatus according to claim 1, wherein the inner baffle assembly comprises a pair of similarly-shaped cylindrical members attached to one another and having a number of through openings creating cooling air passageways extending adjacent and through the inner baffle.

8. The thermally isolating apparatus according to claim 7, wherein each cylindrical member is formed of a number of arc-shaped segments attached end-to-end.

9. A system for thermally isolating a gas turbine engine housing having an outer ring-shaped housing member and an inner hub attached by housing struts from high temperatures created by combustion gases flowing through the turbine engine, comprising:

a floating liner assembly disposed between the inner hub and the outer ring-shaped housing member and including a plurality of liner struts enclosing the housing struts, with a plurality of openings extending through the floating liner;

an outer baffle assembly surrounding the floating liner assembly, with a plurality of openings extending through portions of the outer baffle assembly;

an inner baffle assembly disposed within the floating liner assembly, with a plurality of openings extending through portions the inner baffle; and wherein a continuous stream of pressurized air can enter the outer ring-shaped housing member and flow through the openings in the outer baffle assembly and be directed against the floating liner to collect heat from the floating liner and expel the heat to a stream of combustion gases flowing through the gas turbine engine.

10. The thermally isolating system according to claim 9, wherein the floating liner assembly comprises separate radially-disposed inner and outer ring-shaped members, with each ring-shaped member having a having a number of openings, forming an cooling air passageway adjacent each of the floating liner ring-shaped inner and outer members.

11. The thermally isolating system according to claim 9, wherein the outer baffle assembly is formed of two similar members, with each member having a generally cylindrically-shaped configuration and with each member having a number of through openings forming a compressed air passageway through the outer baffle assembly.

12. The thermally isolating system according to claim 9, wherein the outer baffle assembly is formed of a single, generally cylindrically-shaped member having a plurality of through openings creating air flow passageways through the outer baffle assembly.

13. The thermally isolating system according to claim 9, wherein the outer baffle assembly is formed of a single, generally cylindrically-shaped member having a plurality of through openings formed at either end, creating multiple air passageways through the outer baffle.

14. The thermally isolating system according to claim 9, wherein the inner baffle assembly is formed by a pair of similarly-shaped cylindrical members positioned adjacent to one another and having a number of openings creating multiple passageways through the inner baffle.

15. The thermally isolating system according to claim 14, wherein each cylindrical inner baffle member comprises a number of arc-shaped segments attached end-to-end.

16. The thermally isolating system according to claim 9, wherein the outer ring-shaped housing member includes a number of inlet openings connecting with the continuous stream of pressurized air extending through the outer baffle, floating liner and inner baffle with a stream of pressurized cooling air flowing through the inlet openings.

17. An apparatus and system for thermally isolating an outer ring-shaped housing member of gas turbine engine having a number of inlets and an inner hub attached the outer ring-shaped housing member by a plurality of separate housing struts, from high temperatures created by combustion gases flowing through the turbine engine, comprising:

a floating liner assembly disposed between the inner hub and the outer ring-shaped housing member and comprising separate, radially-disposed inner and outer ring-shaped members, with each ring-shaped member having a having a number of openings, forming a cooling air passageway adjacent each of the floating liner ring-shaped inner and outer members;

an outer baffle assembly formed of two similar, generally cylindrically-shaped members attached to one another and surrounding the floating liner outer ring-shaped member, with a plurality of openings extending through each outer baffle member;

an inner baffle assembly formed of two similar, generally cylindrically-shaped members arranged within the floating liner inner ring-shaped member, with a plurality of openings extending through each inner baffle member; and a single, continuous air circuit extending through the outer ring-shaped housing member and flowing through the openings in the outer and inner baffle assemblies and impacting on each of the floating liner inner and outer ring-shaped members for collecting heat from each of the floating liner inner and outer ring-shaped members and expelling the heat to a stream of combustion gases flowing through the gas turbine engine.

18. The thermally isolating apparatus according to claim 17, wherein a number of doweling pins align the floating liner assembly within the outer ring-shaped housing member.

19. The thermally isolating apparatus according to claim 17, wherein a separate typical metal seals assembly is located between the housing and the outer baffle at both the forward and aft ends of the housing.

20. The thermally isolating apparatus according to claim 17, wherein a separate metal seal assembly is located between the housing and the outer baffle at both the forward and aft ends of the housing.

* * * * *